US007077675B2

(12) United States Patent
Maeda et al.

(10) Patent No.: US 7,077,675 B2
(45) Date of Patent: Jul. 18, 2006

(54) ZIF CONNECTOR IN WHICH A POSITION OF A CONTACT IS AUTOMATICALLY ADJUSTED DURING A CONNECTING OPERATION

(75) Inventors: Toshihiko Maeda, Tokyo (JP); Yoshinori Mizusawa, Tokyo (JP); Isao Takahashi, Tokyo (JP)

(73) Assignees: Japan Aviation Electronics Industry, Limited, Tokyo (JP); NEC Corporation, Tokyo (JP)

( * ) Notice: Subject to any disclaimer, the term of this patent is extended or adjusted under 35 U.S.C. 154(b) by 0 days.

(21) Appl. No.: 11/037,704

(22) Filed: Jan. 18, 2005

(65) Prior Publication Data

US 2005/0186820 A1 Aug. 25, 2005

(30) Foreign Application Priority Data

Jan. 19, 2004 (JP) ..... 2004-010885

(51) Int. Cl.
*H01R 13/15* (2006.01)

(52) U.S. Cl. ..... 439/260; 439/952

(58) Field of Classification Search ..... 439/260, 439/259, 952
See application file for complete search history.

(56) References Cited

U.S. PATENT DOCUMENTS 5,622,505 A * 4/1997 Hashiguchi et al. ..... 439/67
5,676,559 A * 10/1997 Laub et al. ..... 439/260
5,735,709 A * 4/1998 Hashiguchi et al. ..... 439/495
6,890,201 B1 * 5/2005 Hashiguchi et al. ..... 439/259
2004/0229491 A1 * 11/2004 Maeda et al. ..... 439/260

FOREIGN PATENT DOCUMENTS

JP 2000 340310 12/2000

* cited by examiner

*Primary Examiner*—Briggitte Hammond
*Assistant Examiner*—X. Chung-Trans
(74) *Attorney, Agent, or Firm*—Collard & Roe, P.C.

(57) ABSTRACT

In a ZIF connector having first and second connectors, the first connector includes an operating member rotatably held by a first insulator portion holding first contacts arranged adjacent to one another in a predetermined direction. The second connector includes a floating member held by a second insulator portion to be rotatable and slidable in the predetermined direction. The floating member has a first and a second surface which face the first contacts and the operating member, respectively, in a mutually fitted state of the first and the second connectors. Second contacts have one parts held by the first surface and arranged adjacent to one another in the predetermined direction. The floating member is rotated in a first rotating direction to bring the second contacts into contact with the first contacts when the operating member is rotated in the mutually fitted state.

17 Claims, 5 Drawing Sheets

ZIF CONNECTOR IN WHICH A POSITION OF A CONTACT IS AUTOMATICALLY ADJUSTED DURING A CONNECTING OPERATION

This application claims priority to prior Japanese Patent Application JP 2004-10885, the disclosure of which is incorporated herein by reference.

BACKGROUND OF THE INVENTION

This invention relates to a so-called zero insertion force (ZIF) connector which requires only a small force for insertion and removal of connectors into and from each other.

A ZIF connector of the type is disclosed in Japanese Unexamined Patent Application Publication (JP-A) No. 2000-340310. The ZIF connector comprises a first connector and a second connector to be fitted and connected thereto. The first connector has a plurality of contacts held by an insulator and arranged adjacent to one another in a predetermined direction. Generally, the contacts have a predetermined pitch. The insulator rotatably supports a driving member. The driving member has a plurality of cam portions.

Similarly, the second connector has a number of contacts held by an insulator and arranged adjacent to one another in a predetermined direction. Generally, these contacts have a pitch equal to that of the contacts contained in the first connector.

When the first and the second connectors are fitted to each other, the contacts of the first connector and the contacts of the second connector are faced to each other with a space left therebetween. Since no frictional movement is caused between the contacts, only a small force is required for insertion and removal of the first and the second connectors into and from each other. Thereafter, the driving member is rotated. Under the action of the cam portions, the contacts of the first connector are brought into press contact with the contacts of the second connector. Thus, the first and the second connectors are fitted and connected to each other.

In the above-mentioned ZIF connector, it will be assumed that the contacts of the first connector are misaligned with the contacts of the second connector. In other words, the first and the second connectors may sometimes be fitted to each other with their contacts misaligned in position. In this event, smooth fitting between the first and the second connectors may be inhibited. Further, the contacts may be undesiredly and improperly contacted with each other to cause connection error.

SUMMARY OF THE INVENTION

It is therefore an object of this invention to provide a ZIF connector in which a position of a contact is automatically adjusted during a connecting operation.

It is another object of this invention to provide a ZIF connector of the type described, which is capable of smoothly fitting first and second connectors to each other even if misalignment occurs between contacts of the first and the second connectors.

It is still another object of this invention to provide a ZIF connector of the type described, which is capable of easily preventing connection error between first and second connectors to be fitted and connected to each other.

Other objects of the present invention will become clear as the description proceeds.

According to an aspect of the present invention, there is provided a ZIF connector having first and second connectors to be fitted to and released from each other, wherein the first connector comprises a first insulator portion, a plurality of first conductive contacts held by the first insulator portion and arranged adjacent to one another in a predetermined direction, and an operating member rotatably held by the first insulator portion, the second connector comprising a second insulator portion, a floating member held by the second insulator portion to be rotatable and slidable in the predetermined direction, the floating member having a first surface and a second surface which face the first conductive contacts and the operating member, respectively, in a mutually fitted state where the first and the second connectors are fitted to each other, and a plurality of second conductive contacts having one parts held by the first surface and arranged adjacent to one another in the predetermined direction, the floating member being rotated in a first rotating direction to bring the second conductive contacts into contact with the first conductive contacts when the operating member is rotated in the mutually fitted state.

According to another aspect of the present invention, there is provided a second connector to be fitted and connected to a first connector comprising a first insulator portion, a plurality of first conductive contacts held by the first insulator portion and arranged adjacent to one another in a predetermined direction, and an operating member rotatably held by the first insulator portion, the first insulator portion including an insulator holding the first conductive contacts, and a frame coupled to the insulator, holding the operating member, and fitted to the second connector, the second connector comprising a second insulator portion, a floating member held by the second insulator portion to be rotatable and slidable in the predetermined direction, the floating member having a first surface and a second surface facing the first conductive contacts and the operating member, respectively, in a mutually fitted state where the first and the second connectors are fitted to each other, and a plurality of second conductive contacts having one parts held by the first surface and arranged adjacent to one another in the predetermined direction, the floating member being rotated in a first rotating direction to bring the second conductive contacts into contact with the first conductive contacts when the operating member is rotated in the mutually fitted state.

According to still another aspect of the present invention, there is provided a first connector to be fitted and connected to a second connector comprising a second insulator portion, a floating member held by the second insulator portion to be rotatable and slidable in a predetermined direction and having first and second surfaces opposite to each other, and a plurality of second conductive contacts having one parts held by the first surface and arranged adjacent to one another in the predetermined direction, the first connector comprising a first insulator portion, a plurality of conductive contacts held by the first insulator portion and arranged adjacent to one another in the predetermined direction, and an operating member rotatably held by the first insulator portion, the floating member rotating in a first rotating direction to bring the second conductive contacts into contact with the first conductive contacts in a mutually fitted state where the first and the second connectors are fitted to each other.

DESCRIPTION OF THE PREFERRED EMBODIMENT

Figure 1:
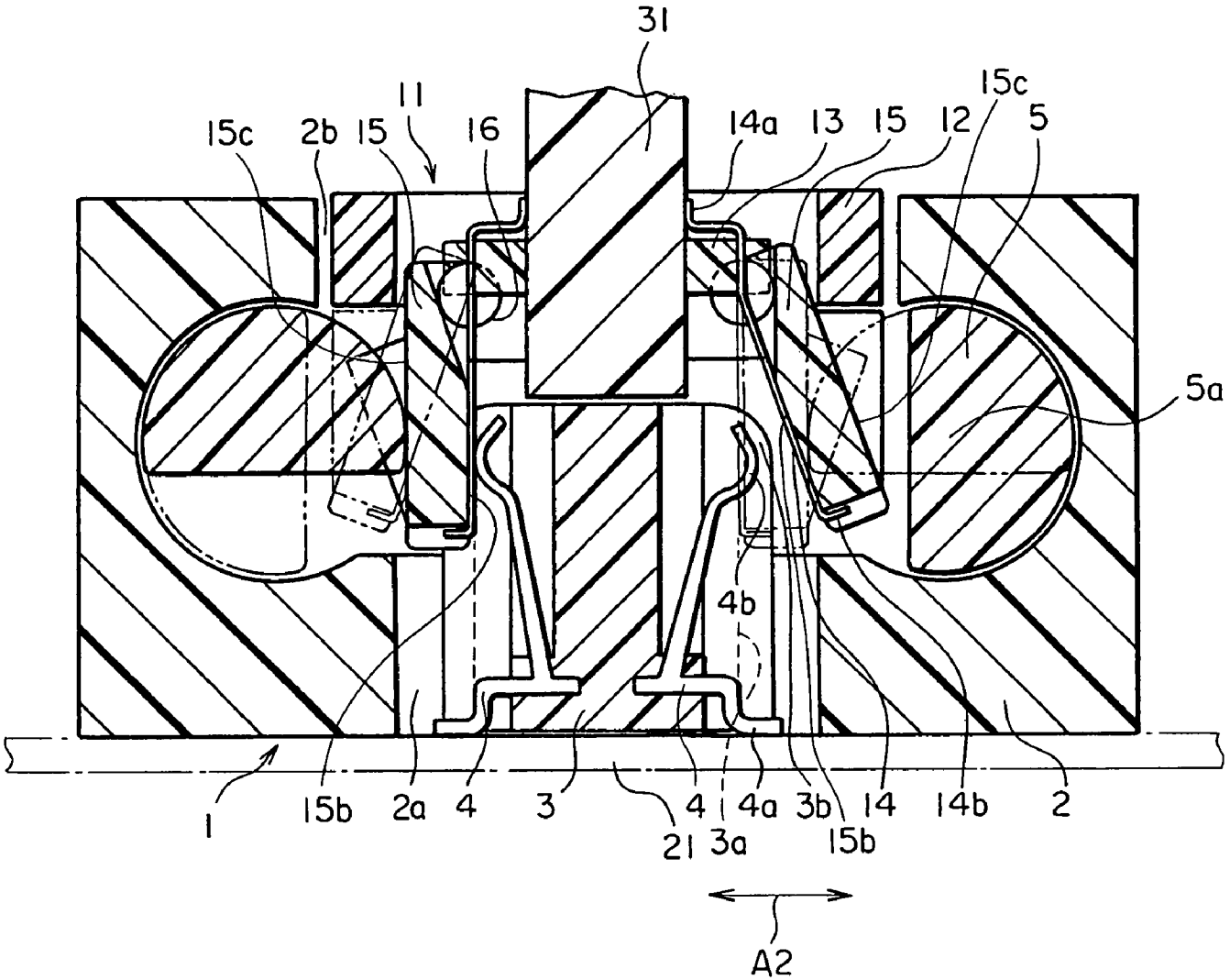
FIG. 1 is a sectional view of a ZIF connector according to an embodiment of this invention, a left half showing a state where first and second connectors are fitted and connected to each other, a right half showing a state where the first and the second connectors are fitted to each other but not connected.
Figure 2:
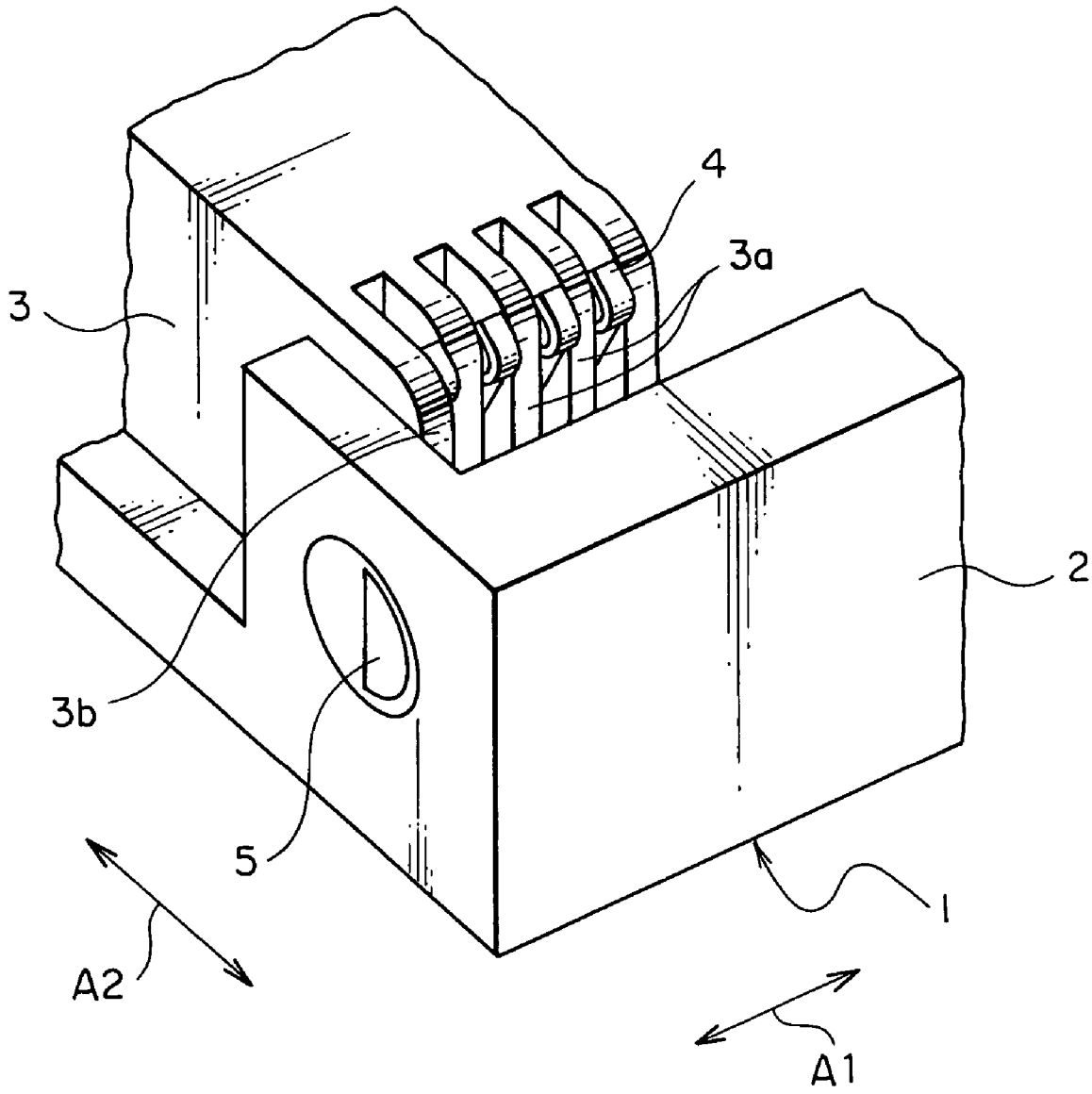
FIG. 2 is a perspective view of a part of the first connector.
Figure 3:
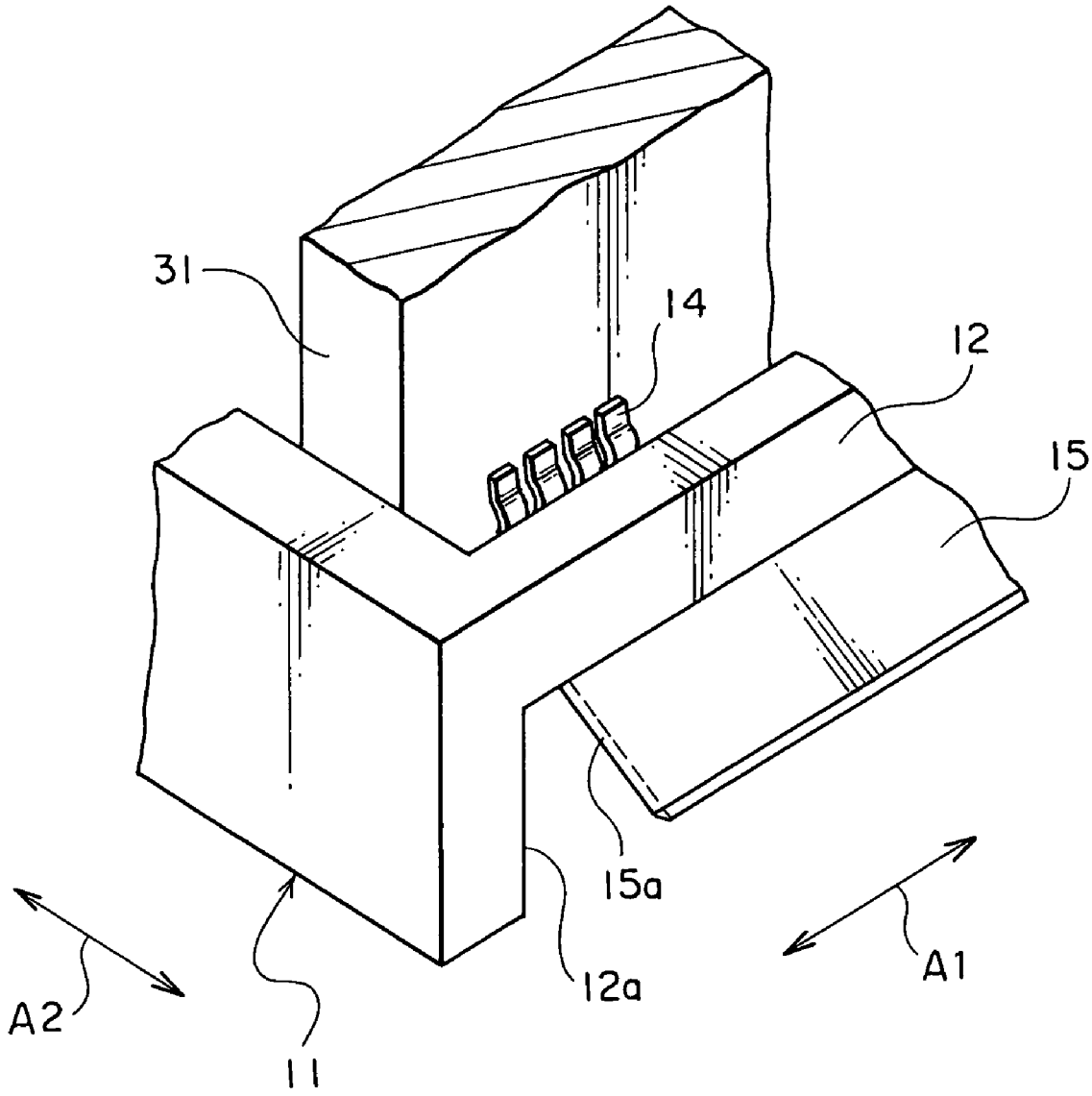
FIG. 3 is a perspective view of a part of the second connector.

Referring to FIGS. 1 through 3, description will be made of a ZIF connector according to an embodiment of this invention.

The ZIF connector illustrated in the figure comprises a first connector 1 and a second connector 11 to be fitted and connected to the first connector 1. For convenience of description, a left half in FIG. 1 shows a state where the first and the second connectors 1 and 11 are fitted and connected to each other while a right half shows a state where the first and the second connectors 1 and 11 are fitted to each other but not connected.

Referring to FIGS. 1 and 2, the first connector 1 is mounted to a mother board 21 and comprises a synthetic resin frame 2 and an insulator 3. A combination of the frame 2 and the insulator 3 may be referred to as a first insulator portion.

The frame 2 defines a lower space 2*a* and an upper space 2*b* at its center. Inside the frame 2, a pair of semicylindrical cams 5 are rotatably held on left and right sides to serve as an operating member. Each of the cams 5 has a center axis extending in a predetermined direction, i.e., a first direction A1 (perpendicular to a drawing sheet of FIG. 1).

The insulator 3 is disposed in the lower space 2*a* of the frame 2 and coupled to the frame 2. On left and right sides of the insulator 3, a number of conductive contacts 4 are held and arranged adjacent to one another at a predetermined pitch in the first direction A1. Each of the contacts 4 has one end 4*a* connected to the mother board 21 and the other end 4*b* of a curved shape. The other end 4*b* of each contact 4 is movable in a second direction A2 (i.e., a horizontal direction in FIG. 1) perpendicular to the first direction A1.

The insulator 3 has a plurality of partition walls 3*a* located between every adjacent ones of the contacts 4, and a pair of guide portions 3*b* formed at opposite ends in the first direction A1. The guide portions 3*b* are protrusions protruding longer than the partition walls 3*a* in the second direction A2. The partition walls 3*a* serve to guide movement of the other ends 4*b* of the contacts 4 and to prevent electrical conduction between every adjacent ones of the contacts 4. The role of the guide portions 3*b* will later be described in detail.

Referring to FIGS. 1 and 3, the second connector 11 is mounted to a daughter board 31 and comprises a synthetic resin frame 12 and an insulator 13. A combination of the frame 12 and the insulator 13 may be referred to as a second insulator portion.

When the first and the second connectors 1 and 11 are fitted to each other, the frame 12 is inserted into the upper space 2*b* of the frame 2 of the first connector 1. The frame 12 has a pair of windows 12*a* formed at positions corresponding to the cams 5 and opened in the second direction A2.

The insulator 13 is located at the center of the frame 12 and coupled to the frame 12. To lower portions of opposite ends of the insulator 13 in the second direction A2, a pair of shafts 16 extending in the first direction A1 are fixed, respectively. A pair of floating members 15 made of an insulating material are held by the shafts 16, respectively, to be rotatable and slidable (as will later be described in detail). The floating members 15 are located at positions corresponding to the windows 12*a* of the frame 12. Each of the floating members 15 has slant surfaces 15*a* formed at opposite ends in the first direction A1. The slant surfaces 15*a* serves to adjust the floating members 15 in position in the first direction A1, in cooperation with the guide portions 3*b* mentioned above. Specifically, when each of the floating members 15 is rotated around the shaft 16 in a first rotating direction from a position depicted by a solid line to another position depicted by a two-dot-and-dash line in the right half of FIG. 1, the slant surfaces 15*a* are engaged with the guide portions 3*b* to position the floating member 15 in the first direction A1. Therefore, each of the floating members 15 smoothly rotates around the shaft 16 and, if necessary, slightly slides along the shaft 16.

On left and right sides of the insulator 13, a number of floating contacts 14 are held and arranged at the predetermined pitch in the first direction A1. Each of the contacts 14 has one part, i.e., one end 14*a* connected to one surface or the other surface of the daughter board 31 and the other part, i.e., the other end 14*b* fixed to each floating member 15. As a consequence, each contact 14 of the second connector 11 has a floating structure. The contacts 14 urge the floating members 15 in a second rotating direction opposite to the first rotating direction. It is to be noted that each of the floating members 15 has a first surface 15*b* and a second surface 15*c* which face the contacts 14 and the cam 15, respectively, in a mutually fitted state where the first and the second connectors 1 and 11 are fitted to each other.

In the state illustrated in the right half of FIG. 1, when the cam 5 is rotated by 90° counterclockwise around its center 5*a*, the floating member 15 is pressed by the cam 5 to rotate around the shaft 16 in the first rotating direction from the position depicted by the solid line to the position depicted by the two-dot-and-dash line. In this event, each floating contact 14 presses the other end 4*b* of each contact 4 to elastically deform the contact 4. As a consequence, the floating contact 14 is brought into press contact with the contact 4 and the state illustrated in the left half of FIG. 1 is reached. Thus, the first and the second connectors 1 and 11 are connected to each other.

Figure 4:
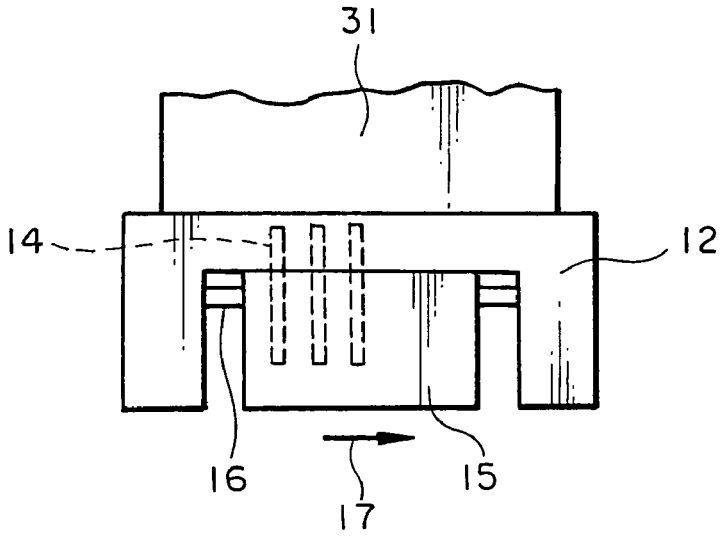
FIG. 4 is a schematic front view of the second connector before connection.
Figure 5:
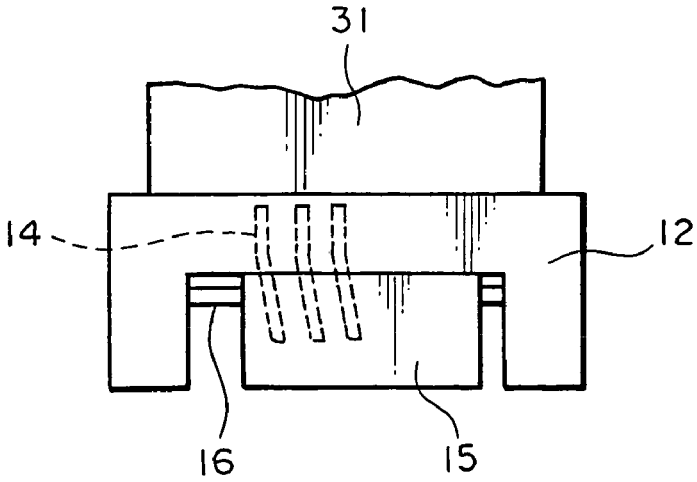
FIG. 5 is a schematic front view of the second connector after connection.

Referring to FIGS. 4 and 5 in addition to FIGS. 1 to 3, description will be made of a function of the floating structure, paying attention to only one of the floating members 15.

It will be assumed as a first case that, in the state where the first and the second connectors 1 and 11 are not connected to each other, the floating contact 14 of the second connector 11 straightly extends in a vertical direction as seen from a front side as illustrated in FIG. 4. In the first case, the floating member 15 is slightly displaced relative to the insulator 3 towards a left side of FIG. 4 in the first direction A1.

When the cam 5 is operated to rotate the floating member 15 in the first rotating direction, a left one of the slant surfaces 15*a* of the floating member 15 is engaged with a left one of the guide portions 3*b* to move the floating member 15 towards a right side of FIG. 4 in the first direction A1. Following the above-mentioned movement of the floating member 15, the other part 14*b* of the floating contact 14 of the second connector 11 moves towards the right side of FIG. 4 in the first direction A1. As a consequence, the floating contact 14 is slightly bent rightward as seen from a front side as illustrated in FIG. 5 to be brought into contact with the contact 4 of the first connector 1.

As a second case, the floating contact 14 of the second connector 11 may have a posture illustrated in FIG. 5 in the state where the first and the second connectors 1 and 11 are not connected to each other. In the second case, it is to be noted that the floating member 15 is slightly displaced relative to the insulator 3 towards a right side of FIG. 5 in the first direction A1 and that the floating contact 14 is slightly bent rightward as seen from a front side as illustrated in FIG. 5.

When the cam 5 is operated to rotate the floating member 15 in the first rotating direction, a right one of the slant surfaces 15*a* of the floating member 15 is engaged with a right one of the guide portions 3*b* to move the floating member 15 towards the left side of FIG. 5 in the first direction A1. Following the above-mentioned movement of the floating member 15, the other part 14*b* of the floating contact 14 of the second connector 11 moves towards the left side of FIG. 5 in the first direction A1. As a consequence, the floating contact 14 straightly extends in the vertical direction as seen from the front side as illustrated in FIG. 4 and brought into contact with the contact 4 of the first connector 1.

In either event, when the floating member 15 is released from a pressing force of the cam 5, the floating member 15 is returned to its initial position by a restoring force of the floating contacts 14.

Figure 6:
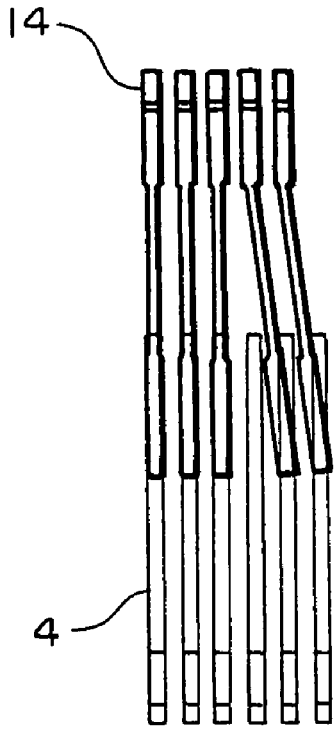
FIG. 6 is a view for describing a positional relationship between a plurality of contacts of the first connector and a plurality of floating contacts of the second connector.

Referring to FIG. 6, the first through the third floating contacts 14 from the left are connected to the first through the third contacts 4 from the left, respectively. The fourth and the fifth floating contacts 14 from the left are inclined and connected to the fifth and the sixth contacts 4 from the left, respectively. Actually, under the function which will presently be described, all of the first through the fifth floating contacts 14 from the left are inclined and connected to the second through the sixth contacts 4 from the left, respectively.

Due to production error of each floating contact 14 or each contact 4 or a fitting posture between the first connector 1 and the second connector 11, it is assumed that all or some of the floating contacts 14 are not inclined and are hardly connected to the contacts 4. In this event, the floating member 15 exhibits the following function. Specifically, when the second connector 11 is fitted to the first connector 1, the floating member 15 is applied with an urging force from the floating contacts 14 in a direction depicted by an arrow 17 as illustrated in FIG. 4 to slide along the shaft 16. The floating member 15 slides by one pitch in the direction depicted by the arrow 17 so that all of the floating contacts 14 are inclined. Therefore, even if the contacts 4 of the first connector 1 and the floating contacts 14 of the second connector 11 are misaligned in position, the first and the second connectors 1 and 11 are smoothly fitted to each other.

While this invention has thus far been described in connection with the preferred embodiment thereof, it will be readily possible for those skilled in the art to put this invention into practice in various other manners without departing from the scope set forth in the appended claims. In the foregoing description, the slant surfaces are formed on the floating member. Alternatively, the slant surfaces may be formed on the frame.

What is claimed is:

1. A ZIF connector having first and second connectors to be fitted to and released from each other, wherein:

the first connector comprises:

a first insulator portion;

a plurality of first conductive contacts held by the first insulator portion and arranged adjacent to one another in a predetermined direction; and an operating member rotatably held by the first insulator portion, the second connector comprising:

a second insulator portion;

a floating member held by the second insulator portion to be rotatable and slidable in the predetermined direction, the floating member having a first surface and a second surface which face the first conductive contacts and the operating member, respectively, in a mutually fitted state where the first and the second connectors are fitted to each other; and a plurality of second conductive contacts having one parts held by the first surface and arranged adjacent to one another in the predetermined direction, the floating member being rotated in a first rotating direction to bring the second conductive contacts into contact with the first conductive contacts when the operating member is rotated in the mutually fitted state.

2. The ZIF connector according to claim 1, wherein the first insulator portion includes an insulator holding the first conductive contacts, and a frame coupled to the insulator, holding the operating member, and fitted to the second connector.

3. The ZIF connector according to claim 2, wherein the insulator has a guide portion for positioning the floating member in the predetermined direction following the rotation of the floating member in the first rotating direction.

4. The ZIF connector according to claim 3, wherein the insulator has a protrusion serving as the guide portion, the floating member having a slant surface to be engaged with the protrusion following the rotation in the first rotating direction.

5. The ZIF connector according to claim 1, wherein the second conductive contacts urge the floating member in a second rotating direction opposite to the first rotating direction.

6. The ZIF connector according to claim 1, wherein each of the second conductive contacts has the other part fixed to the second insulator portion.

7. The ZIF connector according to claim 6, wherein each of the second conductive contacts has a part extending along the first surface between the one part and the other part.

8. The ZIF connector according to claim 1, wherein the second insulator portion includes:

an insulator rotatably holding the floating member; and a frame coupled to the insulator and fitted to the first connector.

9. A second connector to be fitted and connected to a first connector, said first connector comprising a first insulator portion, a plurality of first conductive contacts held by the first insulator portion and arranged adjacent to one another in a predetermined direction, and an operating member rotatably held by the first insulator portion, the first insulator portion including an insulator holding the first conductive contacts, and a frame coupled to the insulator, holding the operating member, and fitted to the second connector, the second connector comprising:

a second insulator portion;

a floating member held by the second insulator portion to be rotatable and slidable in the predetermined direction, the floating member having a first surface and a second surface facing the first conductive contacts and the operating member, respectively, in a mutually fitted state where the first and the second connectors are fitted to each other; and a plurality of second conductive contacts having one parts held by the first surface and arranged adjacent to one another in the predetermined direction, the floating member being rotated in a first rotating direction to bring the second conductive contacts into contact with the first conductive contacts when the operating member is rotated in the mutually fitted state.

10. The second connector according to claim 9, wherein the second conductive contacts urge the floating member in a second rotating direction opposite to the first rotating direction.

11. The second connector according to claim 9, wherein each of the second conductive contacts has the other part fixed to the second insulator portion.

12. The second connector according to claim 11, wherein each of the second conductive contacts has a part extending along the first surface between the one part and the other part.

13. The second connector according to claim 9, wherein the second insulator portion includes:

an insulator rotatably holding the floating member; and a frame coupled to the insulator and fitted to the first connector.

14. A first connector to be fitted and connected to a second connector, said second connector comprising a second insulator portion, a floating member held by the second insulator portion to be rotatable and slidable in a predetermined direction and having first and second surfaces opposite to each other, and a plurality of second conductive contacts having one parts held by the first surface and arranged adjacent to one another in the predetermined direction, the first connector comprising:

a first insulator portion;

a plurality of conductive contacts held by the first insulator portion and arranged adjacent to one another in the predetermined direction; and an operating member rotatably held by the first insulator portion, the floating member rotating in a first rotating direction to bring the second conductive contacts into contact with the first conductive contacts in a mutually fitted state where the first and the second connectors are fitted to each other.

15. The first connector according to claim 14, wherein the first insulator portion includes an insulator holding the first conductive contacts, and a frame coupled to the insulator, holding the operating member, and fitted to the second connector.

16. The first connector according to claim 15, wherein the insulator has a guide portion for positioning the floating member in the predetermined direction following the rotation of the floating member in the first rotating direction.

17. The first connector according to claim 16, wherein the insulator has a protrusion serving as the guide portion, the floating member having a slant surface to be engaged with the protrusion following the rotation in the first rotating direction.

* * * * *